United States Patent [19]

Kurematsu et al.

[11] 4,330,616

[45] May 18, 1982

[54] METHOD FOR PROCESSING SILVER HALIDE COLOR PHOTOGRAPHIC MATERIAL

[75] Inventors: Masayuki Kurematsu; Shigeharu Koboshi, both of Hino, Japan

[73] Assignee: Konishiroku Photo Industry Co., Ltd., Tokyo, Japan

[21] Appl. No.: 286,193

[22] Filed: Jul. 23, 1981

[30] Foreign Application Priority Data

Jul. 31, 1980 [JP] Japan ..... 55-106004

[51] Int. Cl.[3] ..... G03C 7/16; G03C 5/30

[52] U.S. Cl. ..... 430/376; 430/434; 430/442; 430/467; 430/484; 430/488; 430/491

[58] Field of Search ..... 430/405, 419, 420, 434, 430/442, 452, 453, 464, 467, 468, 469, 484, 486, 488, 489, 490, 491, 374, 376, 380

[56] References Cited

U.S. PATENT DOCUMENTS

| | | | |
|---|---|---|---|
| Re. 30,064 | 8/1979 | Shimamura et al. | 430/490 |
| 2,168,181 | 8/1939 | Ulrich et al. | 430/491 |
| 3,201,246 | 8/1965 | Allen et al. | 430/467 |
| 3,839,045 | 10/1974 | Brown | 430/491 |
| 3,994,730 | 11/1976 | Frank | 430/467 |
| 4,170,478 | 10/1979 | Case et al. | 430/467 |
| 4,264,716 | 4/1981 | Vincent et al. | 430/442 |

*Primary Examiner*—Mary F. Downey

*Attorney, Agent, or Firm*—Linda G. Bierman; Jordan B. Bierman

[57] ABSTRACT

A process of developing a color photographic material with a color developer, a diphosphonic acid and a water soluble metallic salt of magnesium, aluminum, zinc, barium or zirconium.

4 Claims, No Drawings

METHOD FOR PROCESSING SILVER HALIDE COLOR PHOTOGRAPHIC MATERIAL

The present invention relates to a color developing process for silver halide photographic material and is particularly concerned with an improvement in preventing precipitation which takes place in the process being performed by the use of a composite of color developer for silver halide photographic material which have been stabilized by an oxidation inhibitor.

Generally in silver halide color photographic material, a color dye image is formed, after image exposure was done, through a series of photographic processes wherein the color developing process and the desilvering process are the basic processes thereof.

In the above-mentioned color developing process, a dye image of an image pattern is formed by a coupling reaction of the oxidant of a color developing agent with the color coupler coexisting therein, and simultaneously reduced silver is produced. The silver produced therein is oxidized thereafter by a bleaching agent in the successive desilvering process and is changed into a soluble silver complex by a fixing agent, and then is dissolved into washing water.

In a practical developing process, besides the basic process for the development or the desilvering, other complementary process are provided therein such as stop bath, emulsion hardening bath, stabilizing bath or a bath for removing backing coat, in the necessity for improving the photographic or physical property of an image.

On the other hand, in ordinary color developing solution, a water soluble salt of sulfite and hydroxylamine or sulfite is added therein as a preservative for anti-oxidization of aromatic primary amine color developing agent.

It has already been known the fact that said sulfite is not always satisfactory in preservability when said sulfite is added alone in a developing solution, therefore, an satisfactory preservability can be obtained by adding water soluble salt of hydroxylamine. Besides, it has also been known that dihydroxyacetone, anilinoethanol, hydroxyl urea or the like can be used as a preservative in place of said sulfite or hydroxylamine.

It has, however, been known the facts that said preservatives are catalyzed and oxidized by a very small amount of coexisting metallic ion, particularly iron ion and their preservative effects are reduced thereby, and that hydroxylamine salts produce ammonia and consequently cyan fogs or stains are caused thereby in a color photographic material. In this connection, in order to improve such abovementioned defects, it has attempted to add aminopolycarboxylic acid into a color developing solution, however, this metallic ion sequestering agent has less effects to prevent a preservative and color developing agent from any decomposition thereof in a composite of developing agent which catalyzedly works against the decomposition, and which, for example, contains a heavy metal such as iron or copper, therefore such chelating agent cannot be used practically. The reason for the above is that the heavy metallic complex of aminopolycarboxylic acid acts as a catalyzer for air-oxidation of the preservative and developing agent.

On the other hand, according to the U.S. Pat. No. 3,214,454 and the German Pat. No. 2,227,639, metallic ion diphosphonic acid sequestering agents can be used in the composite of a color developing agent, among which especially, hydroxyethylidene-diphosphonic acid sequesters such heavy metal in a composite of developing agent which catalyzedly works against the decomposition of preservative, and which comprises a heavy metal such as iron, and also can effectively prevent said preservatives and color developing agent from any decomposition; those facts of the above have become clear.

However, when metallic ion diphosphonic acid sequestering agent is held in a composite of color developing agent in the coexisting of alkaline metallic ion (particularly, sodium ion) and calcium ion, metallic ion diphosphonic acid sequestering agent and calcium-sodium salt are produced and hardly soluble precipitation is also produced.

And, in the U.S. Pat. No. 3,839,045, it has been disclosed therein that the precipitation prevention of said metallic ion hydroxyalkylidene diphosphonic acid sequestering agent and calcium complex can be done by the use of lithium carbonate or lithium sulfate or the like. And, according to the Japanese Laid-Open Patent Publication No. 81337/1975, it has been proposed that 1-3-diamino-2-propanol tetraacetate is used for the purpose of prevention of precipitation caused by diphosphonic acid and calcium.

For the similar purpose, aminopolycarbonate or aminopolyphosphate and diphosphonic acid may be used as disclosed in the U.S. Pat. No. 3,994,730.

However, lithium salt is not only expensive but is unable to achieve the prevention of precipitation of diphosphonic acid-calcium-sodium when the concentration of the diphosphonic acid is high. Further, there is the defect not always satisfactory for the prevention of worsening the effect due to oxidation, in case of adding said aminopolycarbonate having more than three carboxy groups or aminopolyphosphate comprising more than three phospho groups.

As described above, it is extremely difficult to solve various problems in color developing processes.

Accordingly, it is the primary object of the present invention to provide a color developing process that is excellent in long preservability and in stability and is inexpensive in cost; and secondly, to provide a color developing process that can display an excellent stability in preservation even in case that a bleaching solution or bleachfixing solution using ferric salt as a bleaching agent in a process by means of automatic developing machine, for example; and thirdly, to provide a color developing process that is preventable against any fog even in a process using an exhausted developing solution.

The above objects of the invention can be accomplished by processing a silver halide color photographic material in the presence of the following substances defined in (a), (b) and (c) below;

(a) aromatic primary amine color developing agent, (b) diphosphonic acid and (c) a water soluble salt of magnesium, aluminium, zinc, barium or zirconium in a stoichiometrically equivalent or excess amount with respect to that of said diphosphonic acid.

These substances are used, when they are added to a developer composition, in the following amounts; aromatic primary amine color developing agent between approx. 0.1 g and approx. 100 g, preferably 1 g to 25 g, per one liter of developing solution; diphosphonic acid within the range of 0.01 g to 20 g, preferably 0.1 g to 3 g, particularly 0.2 g to 1 g per one liter of developing solution respectively.

Metal atoms having been comprising in the water soluble metallic salt of the invention are required to use in the quantity more than equivalent mol to that of diphosphonic acid and whenever satisfied this condition, any arbitrary quantity thereof can be used. Metallic ion can be used singly or in combination with more than two kinds thereof, and in the latter case it may as well be served if the total quantity of the metal atoms has more than equivalent mol to that of diphosphonic acid.

Those substances (a) to (c) can be added either to a processing solution or to a prebath of said processing solution, in which those substances will be carried over into the processing solution by a photographic material to be processed therein. Further, they can be incorporated into a photographic material to be processed.

As for aromatic primary amine color developing agent, aminophenol and p-phenylenediamine used in ordinary color photographic processes are given as examples. These compounds are normally used in the stable form such as those of hydrochloride and sulfate or as precursor.

As for examples of aminophenol, o-aminophenol, p-aminophenol, 5-amino-2-hydroxy-toluene, 2-amino-3-hydroxy-toluene, 2-hydroxy-3-amino-1,4-dimethylbenzene are given.

As for useful examples of paraphenylene-diamine, there are N,N-dialkyl-p-phenylenediamine derivatives such as monohydrochloride of N,N-diethyl-p-phenylenediamine, monohydrochloride of 2-amino-5-diethylamino-toluene, 4-amino-N-ethyl-N-(β-methane sulfonamido ethyl)-m-toluidine sesquisulfate monohydrate, 4-amino-3-methyl-N-ethyl-N-(β-hydroxy-ethyl)-aniline sulfate, 4-amino-3-(β-methylsulfonamido ethyl)-N,N-diethylaniline hydrochloride, 4-amino-N,N-diethyl-3-(N'-methyl-β-methylsulfonamido)-aniline hydrochloride and the developing agents disclosed in U.S. Pat. Nos. 2,552,241 and 2,566,271. Among the above, as for the particularly preferable compounds, phenylenediamines in which aromatic ring or amino group was substituted for at least one alkyl sulfonamide alkyl group, and phenylene diamines in which hydroxy alkyl group was substituted are given as the examples and besides the above examples, there are p-phenylene diamines, as the particularly preferable compounds, as formulated in the following general formula:

General Formula [I]

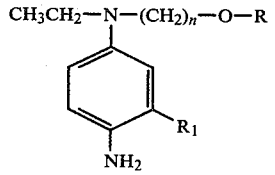

(wherein, the referencial character R represents alkyl group having 1 to 4 carbon atoms; $R_1$ represents alkyl group having 1 to 4 carbon atoms or alkoxy group having 1 to 4 carbon atoms; and n has an integral number of 2 to 4.)

As for examples of the compounds formulated in the formula [I], N-ethyl-N-methoxy ethyl-3-methyl-p-phenylene diamine, N-ethyl-N-methoxy butyl-3-methyl-p-phenylene diamine, N-ethyl-N-ethoxy ethyl-3-methyl-p-phenylene diamine, N-ethyl-N-methoxy ethyl-3-n-propyl-p-phenylene diamine, N-ethylmethoxy ethyl-3-methoxy-p-phenylene diamine, N-ethyl-N-butoxy ethyl-3-methyl-p-phenylene diamine are given.

As for the diphosphonic acid for the use in the invention, any mixtures of two or more metallic ion diphosphonic acid sequestering agents can be used and among them the compounds or the derivatives thereof as formulated in the following general formula [II] are given as the particularly useful compounds for the use in the invention:

General Formula [II]

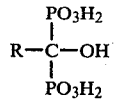

(In the general formula [II], R represents an alkyl group having 1 to 5 carbon atoms.)

And besides, as for the other useful compounds, the compounds and the derivatives thereof as formulated in the following general formula [III]:

General Formula [III]

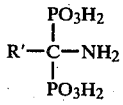

(In the general formula [III], R' represents an alkyl group having 1 to 5 carbon atoms.)

As for examples of the above general formula, 1-hydroxyethylidene 1, 1-diphosphonic acid, 1-hydroxy propylidene-1, 1-diphosphonic acid and the like are given, and as to amino phosphonic acids of the latter, 1-aminoethane-1, 1-diphosphonic acid, 1-amino propane-1, 1-diphosphonic acid and the like are given.

The water soluble metallic salt to be used in the invention is water soluble salt of magnesium, aluminium, zinc, barium or zirconium, which can supply metallic ion to a processing solution. Said water soluble metallic salt includes metallic salts of inorganic or organic acid, and normal salt and acid salt is also held therein.

As for the exemplified compounds thereof, there are given as magnesium sulfate, magnesium nitrate, magnesium chloride, magnesium carbonate, magnesium oxalate, magnesium citrate, aluminium alum sulfate, sodium aluminate, aluminium acetate, zinc sulfate, zinc nitrate, zinc carbonate, barium chloride, barium sulfate, barium hydroxide, zirconium nitrate, zirconium sulfate etc., and those of the metallic salts can be added in the composite of a developing agent or in a photographic material as they are, and can also be added therein after a chelation is formed with diphosphonic acid or iminodicarbonic acid.

In the present invention, the meaning of "processing said in the presence of the matters indicated in (a), (b) and (c)" is that, when a silver halide color photographic material is color-developed, the substances (a), (b) and (c) may independently be incorporated either the silver halide in the photographic material, or in the processing solution such as color developing solution or activator.

According to the embodiments of the invention, a silver halide color photographic material comprising a coupler is processed by a color developing solution which comprises all the substances (a) to (c). According to another embodiment, substance (a) is incorporated in a photographic material and said photographic material is then processed with a solution comprising (b) and (c) for color development.

According to the most preferable embodiment of the invention, in addition to the substances (a) to (c) above, there is added (d) an iminodicarbonic acid or polyphosphoric acid.

Iminodicarbonic acid to be used in the invention is formulated in the following general formula:

General Formula [IV]

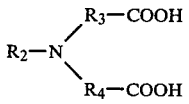

(Wherein, $R_2$ represents hydrogen atom or, alkyl, alyl or phenyl group which is substituted or unsubstituted; $R_3$ and $R_4$ represent alkylene group having 1 to 3 carbon atoms), and for the examples thereof, imino diacetic acid, imino dicarbonic acid, N-methyl imino diacetic acid, N-(3,3-dimethyl butyl) imino diacetic acid, phenyl imino diacetic acid, hydroxy ethyl imino diacetic acid, hydroxy ethyl imino dipropionic acid, amino ethyl imino diacetic acid, phosphonomethyl imino diacetic acid, phosphonoethyl imino diacetic acid are given, however, the imino dicarbonic acid of the invention are not limited thereto of course. And, these can be used as alkalin metallic salts. Particularly preferable metallic ion imino dicarbonic acid sequestering agent for the use in the invention is hydroxyethyl imino diacetic acid, and metallic ion hydroxyethyl imino diacetic acid sequestering agent can be used as hydroxyethyl imino diacetic acid and the alkalin metallic salts thereof such as monosodium salt, disodium salt, monopotassium salt, dipotassium salt and the like.

The metallic ion polyphosphoric acid used in the invention in formulated in the either one of the following general formula:

General Formula [V]

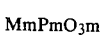

(Wherein, M represents hydrogen atom, alkalin metal atom or ammonium; and m has an integral number of 3 to 6.); or General Formula [VI]

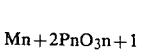

(Wherein, n has an integral number of 2 to 20; M represents the synonymity with that in the general formula [V].) As for the examples thereof, $Na_4P_4O_{12}$, $Na_3P_3O_9$, $H_4P_2O_7$, $Na_5P_3O_{10}$, $Na_6P_4O_{13}$, $Na_{12}P_{12}O_{36}$ are given.

The water soluble metallic salts for the use in the invention are the water soluble salts of aluminium, zirconium, magnesium, barium and zinc, and those are to be added to serve as inorganic salt such as sulfate, carbonate, nitrate, chloride, phosphate, hydroxide and the like, and besides a complex salt is prepared by mixing said water soluble metallic salt and, diphosphonic acid or polyphosphoric acid, and also imino dicarbonic acid and thereafter said complex salt can be added. Magnecium, zirconium, zinc and barium are the metals to be preferably used, and among them magnecium is the particularly preferable one. More than two kinds of water soluble metallic salts can be used jointly in the invention.

Substance (d) may be added, similar to substances (a) to (c), either to photographic material or to processing solution. And polyphosphoric acid or iminodicarbonic acid, which are metallic ion sequestering agents, can be used at the amount within the range of 0.1 to 100 g, preferably 1 g to 25 g, per 1 l of developing solution, and they may be used in combination.

The color developer most preferably used in the invention are characterized in the combined usage of the above described two kinds of metallic ion sequestering agents and the water soluble metallic salt, and imino dicarbonic acid is used therein for the purpose of sequestering calcium ions in a processing solution, and diphosphonic acid is used for the purpose of sequestering iron ion. In an ordinary processing solution, there are much more calcium ions than iron ions, therefore, the amount of iminocarbonic acid to be used is required much more than that of diphosphonic acid. Especially it has been found that hydroxy ethylimino diacetic acid not only has the effects displaying itself as a sequestering agent for metallic ions but also has the oxidation prevention effect on a color developing agent.

And as for the most preferable combination among those of said two kinds of metallic ion sequestering agents and the water soluble metallic salt in the invention, there can be given the combination of hydroxy ethyl iminodiacetic acid formulated in the following formula (1), 1-hydroxy ethylidene-1, 1-diphosphonic acid formulated in the following formula (2) and magnesium sulfate:

Formula (1)

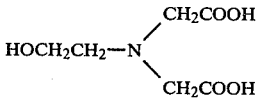

Formula (2)

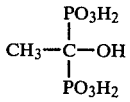

In the present invention, it is suitable that the color development is processed at the temperature between 20° C. and 60° C., preferably between 30° C. and 45° C. And, it is preferable that the pH value of the composite of color developing agent is suitably within the range of approx. 7 to 14, more preferable 8 to 13.

In the present invention, the developer composition can comprise other known ingredients; for example, as for preservative, a water soluble salt of hydroxylamines such as sulfate, chloride, phosphate, etc.; as for alkaline agent, buffering agent, etc., sodium hydroxide, silicate, sodium carbonate, potassium metaborate or borax and the like may independently or combinedly be used. Further, for the necessity of a preparation or for the purpose of increasing ionic strength, etc., it is also possible to use other salts such as disodium monohydricphosphate, sodium bicarbonate and boric acid.

Further, if necessary, it is also possible to add an inorganic or organic anti-foggant such as halide compounds including potassium bromide and potassium iodide; 6-nitrobenzimidazole as described in the U.S. Pat. No. 2,496,940; 5-nitrobenzimidazole as described in the U.S. Pat. Nos. 2,497,917 and 2,656,271; and besides the above, o-phenylenediamine, mercaptobenzimidazole, mercaptobenzoxazole, thiouracil and 5-methylbenztriazole; or, hetero ring compounds as described in the Japanese Patent Examined Publication No. 41675/1971 may be used.

Other than the various sorts of the ingredients, it is possible to add the development inhibitors as disclosed in the Japanese Patent Examined Publication Nos. 19039/1971 and 6149/1970 and U.S. Pat. No. 3,295,976 and, as occasion demands, a development accelerator. Among those development accelerators, there are included therein a varity of pyridinium compounds as representatively described in the U.S. Pat. Nos. 2,648,604 and 3,671,247, and the Japanese Patent Examined Publication No. 9503/1969; other cationic compounds; cationic dyes such as phenosafranine; neutral salts such as thallium nitrate; polyethylene glycol and the derivatives thereof as described in the U.S. Pat. Nos. 2,533,990, 2,531,832, 2,950,970 and 2,577,127, and the Japanese Patent Examined Publication No. 9504/1969; nonionic compounds such as polythioether; organic solvents as described in the Japanese Patent Examined Publication No. 9509/1969; and organic amine, ethanolamine, ethylenediamine, diethanolamine, triethanolamine, etc. And, there are also effective development accelerators such as benzyl alcohol and phenethyl alcohol as described in the U.S. Pat. No. 2,304,925, and besides acetylene glycol, methylethyl ketone, cyclohexane, thioethers, pyridine, ammonia, hydrazine, amines, etc. Further it is also possible to use water softeners such as aminopolycarbonate, or, calcium or magnesium covering agent within the limit not to impede the effectiveness of the invention. And as occasion demands, it can be used ethylene glycol, methyl cellosolve, methanol, acetone, dimethyl formaldehyde, $\beta$ cyclodextrin or other compounds described in the Japanese Patent Examined Publication Nos. 33378/1972 and 9509/1969 to serve as an organic solvent for raising the solubility of a developing agent.

In the color developing solution to be used in the invention, an auxiliary developing agent can be used therein together with a principal developing agent. As for such auxiliary developing agents, there are known, for example, N-methyl-p-aminophenol hemisulfate (metol), 1-phenyl-3-pyrazolidone (phenidone), N,N-diethyl-p-aminophenol chloride, N,N,N',N'-tetramethyl-p-phenylenediamine chloride, and the preferable amount thereof is normally between 0.01 g and 1.0 g/l. Besides the above, as occasion demands, it is also possible to add competing coupler, fogging agent, color coupler, development inhibitor-releasing coupler or development inhibitor-releasing compounds and the like.

Color developing solution will display effective preservation stability particularly in the use of a bleach bath comprising ferric salts as a bleaching agent, in a process.

Said ferric salts are known as aminopolycarboxylic ferrate (III) and polycarboxylic ferrate (III), and they may mostly be brought with an endless belt or leader base fitted to a processing machine into a color developing solution, or be brought with a film hanger into a color developing solution, as it is adhered on the hanger. Also, sometimes bleaching solution is brought by splashing it about into a color developing solution. Normally, it may safely be said that every chemical to be used in a processing agent comprising a small amount of iron ions. However, even if ferric salt is not used as a bleaching agent, the composites of the color developing agents of the invention are excellent in the preservation stability.

The technology of the invention preventing a hardly soluble precipitation of diphosphonic acid - calcium - alkaline metallic salt is useful for the display of a particularly high preservation effect in a color developing solution and this technology will display the effect remarkably also in any kind of photographic processing agent. For example of the processing agent, there are given as black and white developing agent, stop bath, emulsion hardening bath, bleaching bath, bleach-fixing bath, fixing bath, washing bath, preliminary washing bath, fog bath.

The present invention is being described further in detail referring to the following examples, however, the invention is not limited to the specific examples thereof.

EXAMPLE 1

The experiment was performed wherein the undermentioned color developing solution for color printing paper is used as the basic composition thereof.

| | |
|---|---|
| (Color developing solution composition) | |
| Benzyl alcohol | 18.0 ml |
| Ethylene glycol | 20.0 ml |
| Hydroxylamine sulfate | 3.0 g |
| 4-amino-N-ethyl-N-($\beta$-methane sulfon amide ethyl)-m-toluidine sesquisulfate monohydrate | 5.0 g |
| Potassium sulfite (55% solution) | 8.0 ml |
| Sodium carbonate | 20.0 g |
| Potassium carbonate | 10.0 g |
| Sodium bromide | 1.6 g |
| Potassium hydroxide | 1.0 g |
| Fluorescent whitening agent (4,4'-diaminostilbene disulfonate derivative) | 1.0 g |
| Add ion exchange water to make 1 l. | |

For the comparison, the color developing solution No. 1–8 have been prepared, wherein the metallic ion sequestering agent shown in Table 1 was added respectively in the aforesaid color developing solution, and 200 mg of $Ca^{2+}$ ion (in form of $CaCl_2$) per 1 l of the developing solution and 3 mg of $Fe^{3+}$ ion (in form of ethylenediamine tetraacetatoferrate (III)) per 1 l of the developing solution were added therein, and then pH value thereof was adjusted to 10.20.

Further, as for the color developing solution for the comparison and for the invention, the color developing solutions No. 9–No. 26 have been prepared, wherein per 1 l of the developing solution 0.015 mol of 1-hydroxyethylidene-1,1-diphosphonic acid, 0.015 mol of hydroxy ethylimino diacetic acid 200 mg of $Ca^{2+}$ ion (in form of $CaCl_2$) and 3 mg of $Fe^{3+}$ ion (in form of ethylenediamine tetraacetatoferrate (III)) were added, and the metallic salts shown in Table 2 were added therein respectively, and the pH values thereof were adjusted to 10.20 by making use of potassium hydroxide.

Out of each solution thus prepared, 300 ml thereof were put and sealed in an Erlenmeyer flask with ground stopper having a capacity of 500 ml, and preserved at room temperature, and then checked on whether any precipitation has been developed after 3 day, 20 day and 60 day aging respectively, and also checked the percentage of every respective residual amount of hydroxylamine after 20 day and 60 day aging, those of which results are shown in Table 3.

And, the determination of hydroxylamine has been made by the method of exchange to hydroxamic acid by adding ethyl acetate, and thereafter acidified was made by nitric acid and color-developed by ferric chloride, and 530 nm wave length was used.

TABLE 1

| No. | Color Developing Solution | Metallic Ion Sequestering Agent | Amount Added (Per 1 l) |
|---|---|---|---|
| 1 | Comparison | Sodium triphosphate | 0.015 mol |
| 2 | " | 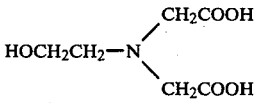 | 0.015 mol |
| 3 | " | 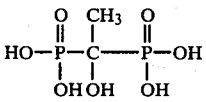 | 0.015 mol |
| 4 | " | 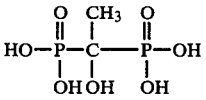 | 0.015 mol |
| | | LiCl | 0.1 mol |
| 5 | " | 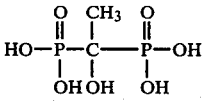 | 0.015 mol |
| | | 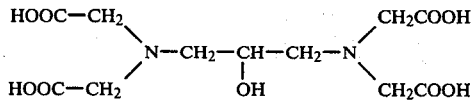 | 0.015 mol |
| 6 | Comparison | 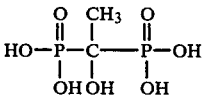 | 0.015 mol |
| | | 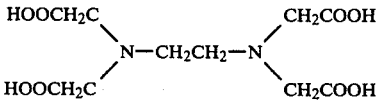 | 0.015 mol |
| 7 | " | 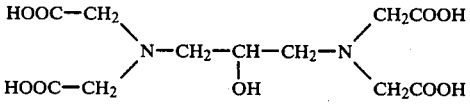 | 0.015 mol |
| 8 | " | 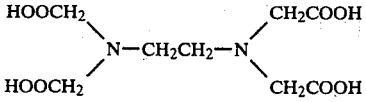 | 0.015 mol |

TABLE 2

| No. | Color Developing Solution | Metallic Salt | Amount Added (Per 1 l) |
|---|---|---|---|
| 9 | Comparison | Nil | Nil |
| 10 | Comparison | LiCl | 0.015 mol |
| 11 | Comparison | LiCl | 0.1 mol |
| 12 | Comparison | $BeCl_2$ | 0.015 mol |
| 13 | Comparison | $Bi(NO_3)_3$ | 0.015 mol |
| 14 | Comparison | $Ce(SO_4)_2$ | 0.015 mol |
| 15 | Comparison | $CoCl_2$ | 0.015 mol |

TABLE 2-continued

| No. | Color Developing Solution | Metallic Salt | Amount Added (Per 1 l) |
|---|---|---|---|
| 16 | Comparison | $CuCl_2$ | 0.015 mol |
| 17 | Comparison | $MnSO_4$ | 0.015 mol |
| 18 | Comparison | $NiSO_4$ | 0.015 mol |
| 19 | Comparison | $Pb(NO_3)_2$ | 0.015 mol |
| 20 | Comparison | $SrCl_2$ | 0.015 mol |
| 21 | Comparison | $SnCl_4$ | 0.015 mol |
| 22 | The Invention | $K_2Al_2(SO_4)_4$ | 0.015 mol |
| 23 | The Invention | $Zr(SO_4)_2$ | 0.015 mol |
| 24 | The Invention | $ZnSO_4$ | 0.015 mol |
| 25 | The Invention | $BaCl_2$ | 0.015 mol |
| 26 | The Invention | $MgSO_4$ | 0.015 mol |

TABLE 3

| Developing Solution | | Precipitation 3 Day Aging | Precipitation 20 Day Aging | Precipitation 60 Day Aging | Hydroxylamine Residual(%) 20 Day Aging | Hydroxylamine Residual(%) 60 Day Aging |
|---|---|---|---|---|---|---|
| Comparison | 1 | Nil | Nil | Nil | 41 | 0 |
| Comparison | 2 | Nil | Nil | Nil | 30 | 0 |
| Comparison | 3 | Yes | — | — | 75 | 34 |
| Comparison | 4 | Nil | Yes | — | 85 | 28 |
| Comparison | 5 | Nil | Nil | Nil | 75 | 35 |
| Comparison | 6 | Nil | Nil | Nil | 15 | 0 |
| Comparison | 7 | Nil | Nil | Nil | 60 | 10 |
| Comparison | 8 | Nil | Nil | Nil | 12 | 0 |
| Comparison | 9 | Nil | Yes | — | 82 | 30 |
| Comparison | 10 | Nil | Yes | — | 83 | 30 |
| Comparison | 11 | Nil | Nil | Yes | 80 | 39 |
| Comparison | 12 | Nil | Yes | — | 81 | 30 |
| Comparison | 13 | Nil | Nil | Yes | 72 | 35 |
| Comparison | 14 | Nil | Nil | Yes | 20 | 0 |
| Comparison | 15 | Nil | Yes | — | 10 | 0 |
| Comparison | 16 | Nil | Yes | — | 5 | 0 |
| Comparison | 17 | Nil | Yes | — | 10 | 0 |
| Comparison | 18 | Nil | Yes | — | 5 | 0 |
| Comparison | 19 | Nil | Nil | Yes | 68 | 30 |
| Comparison | 20 | Nil | Yes | — | 74 | 35 |
| Comparison | 21 | Nil | Nil | Yes | 78 | 30 |
| The Invention | 22 | Nil | Nil | Nil | 84 | 52 |
| The Invention | 23 | Nil | Nil | Nil | 86 | 61 |
| The Invention | 24 | Nil | Nil | Nil | 83 | 60 |
| The Invention | 25 | Nil | Nil | Nil | 88 | 62 |
| The Invention | 26 | Nil | Nil | Nil | 91 | 65 |

As is obvious from Table 3, the developing solution for solely using so far publicly known metallic ion sequestering agent have unfavorable residual property of hydroxylamine, and the developing solutions using diphosphonic acid as a metallic ion sequestering agent and a publicly known precipitation prevention agent have less precipitation prevention effect and also cause precipitation in a long preservation, therefore, it can be found that a favorable effect cannot be obtained for the residual property of hydroxylamine. And, if the other water soluble metallic salt than those of the invention is added, it is found the facts that the precipitation prevention effect thereof is less, and that nickel, copper, etc. make hydroxylamine decomposition accelerate.

The color developing solutions No. 22–26 combinedly using the metallic ion sequestering agent and water soluble metallic salt of the invention have no precipitation and also have a markedly more excellent residual property of hydroxylamine than those of the color developing solutions No. 1–8 combining a conventional metallic ion sequestering agent and/or metallic salt.

EXAMPLE 2

In this example, 3 g of hydroxyethylimino diacetic acid, 200 mg of $Ca^{2+}$ ions (added in form of $CaCl_2$) and 3 mg of $Fe^{3+}$ ions (added in form of ethylene diamine tetraacetatoferrate (III)) were added for 1 l of the color developing solution for color printing paper use designated in the Example 1, and then, as shown in Table 4, the respective amounts of 1-hydroxyethylidene-1,1-diphosphonic acid (HEDP) and lithium, magnesium, and barius were changed.

The pH value of thus prepared each solution was adjusted to 10.20 by use of potassium hydroxide and each of the solutions was filled up to the mouth of an Erlenmeyer flask having the capacity of 1 l up to its mouth and preserved at room temperature.

Table 5 illustrates the results examined the percentage of hydroxylamine residual and the precipitation occurrence having taken place after 20 days aging while the amount evaporated were being compensated with ion exchange water.

TABLE 4

| Amount Added | | Color Developing Solution No. Comparison 27 | 28 | 29 | 30 | 31 | 32 | 33 | 34 | The Invention 35 | 36 | 37 | 38 | 39 | 40 | 41 | 42 | 43 | 44 |
|---|---|---|---|---|---|---|---|---|---|---|---|---|---|---|---|---|---|---|---|
| HEDP | (g/l) | 0.5 | 0.5 | 0.5 | 3 | 3 | 0.5 | 0.5 | 0.5 | 0.5 | 0.5 | 0.5 | 0.05 | 0.15 | 0.2 | 3 | 6 | 0.5 | 0.5 |
| $Mg^{2+}$ Ion (Mg/HEDP) | Molar fraction | | | | | | ½ | | ½ | 1/1 | 2/1 | 5/1 | 1/1 | 1/1 | 1/1 | 1/1 | 1/1 | ½ | |
| $Ba^{2+}$ Ion $\left(\frac{Ba^{2+}}{HEDP}\right)$ | Molar fraction | | | | | | | ½ | ⅓ | | | | | | | | | ½ | 1/1 |
| $Li^{+}$ Ion $\left(\frac{Li}{HEDP}\right)$ | Molar fraction | 1/1 | 5/1 | $\frac{20}{1}$ | 1/1 | $\frac{20}{1}$ | | | | | | | | | | | | | |

TABLE 5

| Color Developing Solution No. | Precipitation Occurrence | Hydroxylamine Residual (%) |
|---|---|---|
| 27 Comparison | Yes | 30 |
| 28 Comparison | Yes | 32 |
| 29 Comparison | Nil | 49 |
| 30 Comparison | Yes | 31 |
| 31 Comparison | Yes | 32 |
| 32 Comparison | Yes | 33 |
| 33 Comparison | Yes | 31 |
| 34 Comparison | Yes | 41 |
| 35 The Invention | Nil | 85 |
| 36 The Invention | Nil | 86 |
| 37 The Invention | Nil | 76 |
| 38 The Invention | Nil | 57 |
| 39 The Invention | Nil | 71 |
| 40 The Invention | Nil | 77 |
| 41 The Invention | Nil | 84 |
| 42 The Invention | Nil | 86 |
| 43 The Invention | Nil | 80 |
| 44 The Invention | Nil | 77 |

As is obvious from Table 5, it is found the facts from the results of the experiments on the solution No. 27–No. 31 comparison shown therein that lithium ion should be necessary in great quantity to prevent HEDP from occurrence of precipitation and therefore when HEDP is increased in quantity, precipitation cannot be prevented, and the prevention from decomposing hydroxylamine is also less effective than those of the solutions of the invention.

And, from the results of the experiments on the solution No. 32–37, it is observed therein no precipitation occurred due to a long preservation with the solutions added more than equivalent mol of metallic ion of the invention than that of diphosphonic acid.

Further, from the results of the experiments on the solutions No. 38–42, it is found the fact that, when the amount added of diphosphonic acid is less, hydroxylamine decomposition prevention effect obtainable by $Fe^{3+}$ is less. And, from the case of the solution No. 17 it is found the fact that there is the effectiveness when an equivalent mol of the metallic ions of the invention in the total amount is added.

Still further, it is also found the fact that the precipitation occurrence of said diphosphonic acid and Ca or Na affects the percentage of hydroxylamine residuals.

EXAMPLE 3

In this example, 0.5 g of 1-hydroxyethylidene-1,1-diphosphonic acid and 0.84 g of magnesium sulfate septhydrate were added into 1 l of the color developing solution for color printing paper use designated in the Example 1, and the metallic ion sequestering agent described in Table 5 was added, and, $Ca^{2+}$ ion (added in form of $CaCl_2$) was set at 100 ppm and $Fe^{3+}$ ion (added in form of ethylene diamine tetraacetoferrate (III)) was set at 3 ppm, and then the pH value of each solution was adjusted to 10.20, and consequently the color developing solutions No. 45 to 56 have been prepared thereby. And, each of the solutions was filled up to the mouth of an Erlenmeyer flask having a capacity of 1 l and preserved at room temperature. Table 7 illustrates the results of the percentages measured of hydroxylamine, potassium sulfite and developing agent of each solution after preserved for 20 days aging while the amounts evaporated were being compensated with ion exchange water.

Further, in order to investigate fog caused by developing, a color photographic material has been prepared as a sample, wherein the undermentioned layers were coated onto a support comprising polyethylene coated paper in order from the side of said support, and at that time two kinds of intermediate layers (i.e., the undermentioned layers No. 2 and 4) were provided together so that the layer could be of 1μ in dry thickness.

Layer No. 1: The coating is made so that the amount of silver to be coated can be 400 mg/m² with blue-sensitive silver halide emulsion comprising yellow coupler (which is silver chlorobromide emulsion comprising 1 mol % of silver iode and 80% mol of silver bromide, wherein 400 g of gelatin are held in every 1 mol of silver halide and the sensitivity is increased by the use of $2.5\times10^{-4}$ mol of the following sensitizing dye per 1 mol of silver halide:

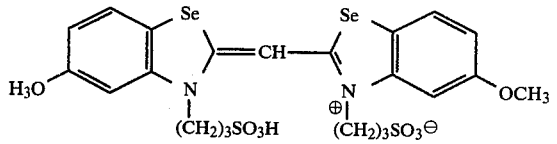

and, $2\times10^{-1}$ mol of the following couplers having been decomposed by being dissolved in dibutyl phthalate are held therein per 1 mol of silver halide.

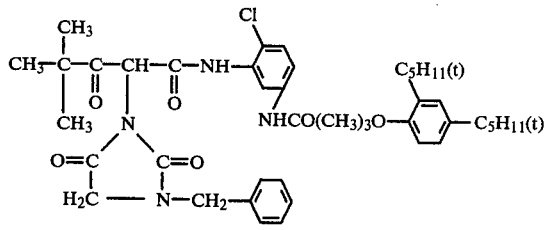

Layer No. 2: Gelatin layer (Intermediate layer)

Layer No. 3: The coating is made so that the amount of silver to be coated can be 500 mg/m² with green-sensitive silver halide emulsion comprising magenta coupler (which is silver chlorobromide emulsion comprising 80 mol % of silver bromide, wherein 500 g of gelatin are held in per 1 mol of silver halide and the sensitivity thereof is increased by the use of $2.5\times10^{-4}$ mol of the following sensitizing dye per 1 mol of silver halide,

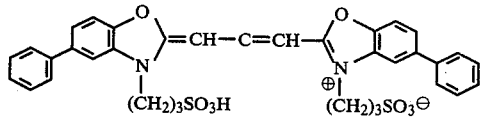

and, $2\times10^{-1}$ mol of the following coupler having been decomposed by being dissolved in tricresyl phosphate are held therein per 1 mol of silver halide.

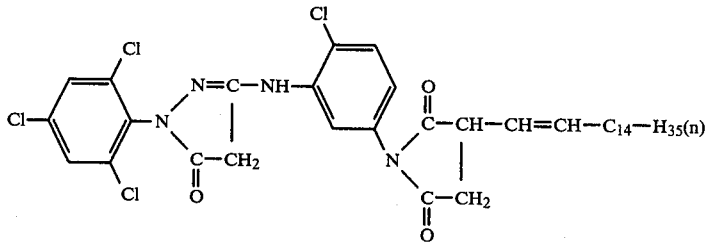

Layer No. 4: Gelatin layer (Intermediate layer)

Layer No. 5: The coating is made so that the amount of silver to be coated can be 500 mg/m² with red-sensitive silver halide emulsion comprising cyan coupler (which is silver chlorobromide emulsion comprising 80% mol of silver bromide, wherein 500 g of gelatin per mol of silver halide are held in, and the sensitivity thereof is increased by the use of $2.5\times10^{-4}$ mol of the following sensitizing dye per 1 mol of silver halide,

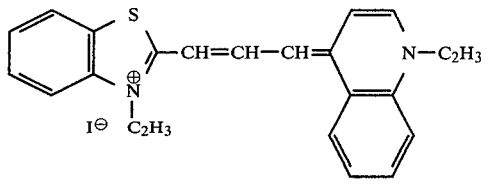

and, $2\times10^{-1}$ mol of the following coupler having been decomposed by being dissolved in tricresyl phosphate are held therein per 1 mol of silver halide.

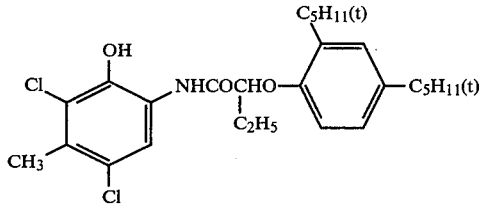

Layer No. 6: Gelatin layer (protective layer).

Dry thickness: 1μ.

Each of the silver halide emulsions having used in layer No. 1, 3 and 5 respectively was prepared according to the process described in the photographic chemistry, vol. 1, page 346 (authored by Grafkides: published by Fountain Press) and chemically sensitized respectively by making use of sodium thiosulfate pentahydrate and also comprise therein with 4-hydroxy-6-methyl-1,3,3a,7-tetrazaindene.sodium salt as a stabilizer, bisether (vinylsulfonyl methyl) as an emulsion hardener and saponine as a coating assistant.

Exposure to white light was given onto the respective samples thus prepared as described above through an optical wedge by the use of a photosensitometer (Model KS-7 mfd. by Konishiroku Photo Ind. Co., Ltd.) and then were processed in accordance with the following process and by making use of the developing solutions No. 45 to 56 which have been preserved for thirty days.

| | Process | Temperature (°C.) | Time (min.) |
|---|---|---|---|
| 1. | Color developing | 38 | 3.5 |
| 2. | Bleach-Fixing | 33 | 1.5 |
| 3. | Washing | 31 | 2.0 |
| 4. | Drying | 60–80° C. | |

The composition of the bleach-fixing solution used is as follows:

| (Composition of Bleach-Fixing Solution) | |
|---|---|
| Iron ammonium ethylenediamine tetraacetate monohydrate | 60 g |
| Ammonium ethylenediamine tetraacetate monohydrate | 4 g |
| Ammonia solution (20%) | 10 ml |
| 70% solution of ammonium thiosulfate | 160 ml |
| 50% solution of ammonium sulfite | 20 ml |
| Add water to make 1 l. | |

The pH value was adjusted to 6.9 by the use of ammonium hydroxide or acetic acid. The fog density of thus obtained samples were measured by a photoelectric densitometer (Model PDA-60, mfd. by Konishiroku Photo Ind. Co., Ltd.) and the results of which are shown in Table 7.

And, the values of the determination of color developing agents have been obtained through the process, wherein, after extracted by the use of chloroform, a re-extraction was made by the use of sulfuric acid solution and then a potentiometric titration was performed respectively.

TABLE 6

| Developing Solution | Metallic Ion Sequestering Agent | Amount Added (per 1 l) |
|---|---|---|
| 45 Comparison | 1,2-cyclohexanediamine-N,N,N',N'-tetraacetic acid | 3 g |
| 46 Comparison | Nitrilotriacetic acid | 3 g |
| 47 Comparison | 2-phosphonobutane-1,2,4-tricarbonic acid | 3 g |
| 48 Comparison | Ethylenediamine tetramethylene phosphonic acid | 3 g |
| 49 Comparison | Citric acid | 5 g |
| 50 The Invention | Hydroxyethyliminodiacetic acid | 3 g |
| 51 The Invention | Aminoethyliminodiacetic acid | 3 g |
| 52 The Invention | Phosphonomethyliminodiacetic acid | 3 g |
| 53 The Invention | Iminodiacetic acid | 3 g |
| 54 The Invention | Sodium triphosphoric acid | 3 g |
| 55 The Invention | Sodium tetrapolyphosphoric acid | 5 g |
| 56 The Invention | Sodium hexametaphosphoric acid | 5 g |

TABLE 7

| Developing Solution No. | Residual Percentage (%) Hydroxylamine | Potassium sulfite | Developing Agent | Fog Density B | G | R |
|---|---|---|---|---|---|---|
| 45 | 33 | 51 | 90 | 0.10 | 0.09 | 0.12 |
| 46 | 23 | 50 | 85 | 0.10 | 0.09 | 0.13 |
| 47 | 45 | 33 | 84 | 0.10 | 0.09 | 0.10 |
| 48 | 51 | 31 | 82 | 0.09 | 0.08 | 0.07 |
| 49 | 53 | 16 | 80 | 0.10 | 0.08 | 0.07 |
| 50 | 86 | 60 | 95 | 0.06 | 0.05 | 0.04 |
| 51 | 74 | 59 | 91 | 0.06 | 0.05 | 0.04 |
| 52 | 80 | 55 | 94 | 0.06 | 0.05 | 0.04 |
| 53 | 78 | 58 | 92 | 0.06 | 0.05 | 0.04 |
| 54 | 77 | 54 | 93 | 0.06 | 0.05 | 0.04 |
| 55 | 71 | 50 | 90 | 0.06 | 0.05 | 0.04 |
| 56 | 72 | 51 | 89 | 0.06 | 0.05 | 0.04 |

B: The reflection density of blue light
G: The reflection density of green light
R: The reflection density of red light As shown in Table 7, the comparison samples No. 45 and 46 are preventively effective against decomposition of potassium sulfite and developing agent, but are ineffective against any decomposition and fog density of hydroxylamine. The comparison samples No. 47 to 49 have inferior fog density and residual percentages of hydroxylamine and therefore they cannot be put to practical use.

In contrast with the above samples, in Samples No. 50 to 56 for the invention use, decomposition of potassium sulfite and developing agent are extremely less and fog are also extremely less, therefore it is found that they are excellently effective. Further, nothing of precipitation occurrence was observed at all in the samples No. 45 to 56 and it was found the fact that $Mg^{2+}$ ion can completely prevent any precipitation from occurrence, irrespective of any kind of metallic ion sequestering agents. Also it is found the fact that hydroxyethyl iminodiacetic acid in the sample No. 50 among the iminodicarbonic acid of the invention is particularly superior.

Also, the inventors have made the examinations of the residual percentages and precipitation occurrence of developing agents in the system not having been added with hydroxylamine of the color developing solution described in the Example 3, wherein they have also found no precipitation occurrence and obtained an excellent result of the residual percentage of developing agent with the solutions of the invention as well. However, compared with the ones added hydroxylamine, they are lower in the residual percentage and not preferable to use, but in the system wherein hydroxylamine is prohibited from using because it is a violent poison, a better result can be obtained in comparison with the results from the use of so far publicly known metallic sequestering agents without comprising hydroxylamine.

Also, when adding a metallic salt of the invention in a developing solution, it would be preferable to add it in form of water solution from the viewpoint of solubility, and when it is prepared into a developing kit it is possible to dissolve and add it into an organic solvent such as ethylene glycol and benzyl alcohol.

EXAMPLE 4

In this example, 0.015 mol of 1-hydroxyethylidene-1,1-diphosphonic acid, 150 mg of $Ca^{2+}$ ions (added in form of $CaCl_2$) and 3 mg of $Fe^{3+}$ ions (added in form of ethylenediaminetetraacetatoferrate (III) were added into every 1 l of color developing solution for color printing paper use designated in the Example 1, the metallic salts shown in Table 8 were added respectively, and the pH values thereof were adjusted to 10.20 by making use of potassium hydroxide. And each of the solutions was filled up to the mouth of an Erlenmeyer flask having a capacity of 1 l and preserved at room temperature. Table 9 illustrates the results of the percentages measured of hydroxylamine and developing agent of each solution after preserved for 25 days aging while the amounts evaporated were being compensated with ion exchange water.

TABLE 8

| No. | Color Developing Solution | Metallic Salt | Amount Added (per 1 l) |
|---|---|---|---|
| 57 | Comparison | LiCl | 0.015 mol |
| 58 | Comparison | LiCl | 0.10 mol |
| 59 | Comparison | $BeCl_2$ | 0.015 mol |
| 60 | Comparison | $Bi(NO_3)_3$ | 0.015 mol |
| 61 | The Invention | $K_2Al_2(SO_4)_4$ | 0.015 mol |
| 62 | The Invention | $BaCl_2$ | 0.015 mol |
| 63 | The Invention | $ZnSO_4$ | 0.015 mol |
| 64 | The Invention | $Zr(SO_4)_2$ | 0.015 mol |

TABLE 8-continued

| No. | Color Developing Solution | Metallic Salt | Amount Added (per 1 l) |
|---|---|---|---|
| 65 | The Invention | $MgCl_2$ | 0.015 mol |

As shown in Table 9, it is found that the processes of the invention without iminodicarbonic acid or polyphosphoric acid also have excellent effect on residual percentage of hydroxylamine and developing agent against those of the comparison.

TABLE 9

| Developing Solution No. | Residual Percentage (%) | |
|---|---|---|
| | Hydroxylamine | Developing Agent |
| 57 | 40 | 74 |
| 58 | 60 | 75 |
| 59 | 38 | 72 |
| 60 | 37 | 72 |
| 61 | 73 | 80 |
| 62 | 65 | 76 |
| 63 | 69 | 80 |
| 64 | 72 | 81 |
| 65 | 80 | 86 |

We claim:

1. A method for processing a silver halide color photographic material which comprises processing said color photographic material in the presence of (a) an aromatic primary amine color developing agent, (b) a diphosphonic acid, and (c) a water soluble metallic salt of magnesium, aluminium, zinc, barium or zirconium in a stoichiometrically equivalent or excess amount with respect to that of diphosphonic acid.

2. A method according to claim 1, wherein the water soluble metallic salt is water soluble metallic salt of magnesium.

3. A method for processing a silver halide color photographic material which comprises processing said color photographic material in the presence of (a) an aromatic primary amine color developing agent, (b) a diphosphonic acid, (c) a water soluble metallic salt of magnesium, aluminium, zinc, barium or zirconium in a stoichiometrically equivalent or excess amount with respect to that of diphosphonic acid, and (d) an iminodicarbonic acid or a polyphosphoric acid.

4. An aqueous color developing solution which comprises (a) an aromatic primary amine color developing agent, (b) a diphosphonic acid, (c) a water soluble metallic salt of magnesium, aluminium, zinc, barium or zirconium in an amount stoichiometrically equivalent or excess with respect to that of diphosphonic acid, and (d) an iminodicarbonic acid or a polyphosphoric acid.

* * * * *